US011657995B2

(12) United States Patent
Nishida et al.

(10) Patent No.: US 11,657,995 B2
(45) Date of Patent: May 23, 2023

(54) ELECTROMAGNETIC RELAY WITH POSITIONAL SECUREMENT FOR FIXED TERMINALS

(71) Applicant: OMRON Corporation, Kyoto (JP)

(72) Inventors: Takeshi Nishida, Kyoto (JP); Kazuki Furukawa, Kyoto (JP); Naoki Kawaguchi, Kyoto (JP); Takashi Tsukada, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/689,987

(22) Filed: Mar. 9, 2022

(65) Prior Publication Data

US 2022/0293381 A1 Sep. 15, 2022

(30) Foreign Application Priority Data

Mar. 15, 2021 (JP) ..... JP2021-041571

(51) Int. Cl.

| | |
|---|---|
| ***H01H 50/60*** | (2006.01) |
| ***H01H 50/58*** | (2006.01) |
| ***H01H 50/04*** | (2006.01) |
| *H01H 50/36* | (2006.01) |

(52) U.S. Cl.

CPC ..... *H01H 50/60* (2013.01); *H01H 50/045* (2013.01); *H01H 50/58* (2013.01); *H01H 50/36* (2013.01); *H01H 2205/002* (2013.01)

(58) Field of Classification Search

CPC ..... H01H 50/60; H01H 50/045; H01H 50/58; H01H 50/36; H01H 2205/002; H01H 50/14; H01H 50/16; H01H 50/54

See application file for complete search history.

(56) References Cited

U.S. PATENT DOCUMENTS

| | | | | |
|---|---|---|---|---|
| 7,187,257 | B2 * | 3/2007 | Mochizuki | H01H 50/14 335/78 |
| 8,193,881 | B2 * | 6/2012 | Yuba | H01H 9/443 335/78 |
| 2017/0133183 | A1 * | 5/2017 | Hasegawa | H01H 50/58 |
| 2019/0103240 | A1 | 4/2019 | Li et al. | |

(Continued)

FOREIGN PATENT DOCUMENTS

JP 2019-67640 A 4/2019

*Primary Examiner* — Bernard Rojas

(74) *Attorney, Agent, or Firm* — Shinjyu Global IP

(57) ABSTRACT

An electromagnetic relay includes a fixed terminal, a movable contact piece, and a support portion supporting the fixed terminal. The fixed terminal includes a fixed contact, a first terminal portion on which the fixed contact is disposed, a second terminal portion extending from one of both ends of the first terminal portion, a first protrusion disposed on the second terminal portion. The fixed terminal is bent between the first and second terminal portions. The first terminal portion has a first terminal surface opposite to the movable contact piece. The second terminal portion has a second terminal surface connected to the first terminal surface. The support portion has a contact surface contacting the first terminal surface of the first terminal portion, and a first side surface including a first groove where the first protrusion is fitted. The first protrusion is disposed on the second terminal surface of the second terminal portion.

6 Claims, 11 Drawing Sheets

(56) References Cited

U.S. PATENT DOCUMENTS

| | | | | |
|---|---|---|---|---|
| 2020/0020497 | A1* | 1/2020 | Li | H01H 50/548 |
| 2022/0293373 | A1* | 9/2022 | Nishida | H01H 50/04 |
| 2022/0293374 | A1* | 9/2022 | Tsukada | H01H 50/041 |
| 2022/0293381 | A1* | 9/2022 | Nishida | H01H 50/045 |

* cited by examiner

ELECTROMAGNETIC RELAY WITH POSITIONAL SECUREMENT FOR FIXED TERMINALS

CROSS-REFERENCE TO RELATED APPLICATION

This application claims priority to Japanese Patent Application No. 2021-041571, filed Mar. 15, 2021. The contents of that application are incorporated by reference herein in their entirety.

FIELD

The present disclosure relates to an electromagnetic relay.

BACKGROUND

Conventionally, electromagnetic relays are known that open and close an electric circuit. For example, the electromagnetic relay disclosed in Japanese Laid-Open Patent Publication No. 2019-67640 includes a fixed terminal having a fixed contact and a movable contact piece having a movable contact. The fixed terminal penetrates a base and a portion of the fixed terminal on which the fixed contact is disposed is placed on the base, whereby the fixed terminal is fixed to the base.

SUMMARY

However, in the electromagnetic relay disclosed in Japanese Laid-Open Patent Publication No. 2019-67640, the fixed terminal is fixed to the base only at a portion thereof that penetrates the base. This may cause a positional deviation of the fixed terminal when external force is applied to a portion of the fixed terminal exposed from the base.

An object of the present disclosure is to provide an electromagnetic relay capable of reducing a positional deviation.

An electromagnetic relay according to one aspect of the present disclosure includes a fixed terminal, a movable contact piece, and a support portion. The fixed terminal includes a fixed contact, a first terminal portion, a second terminal portion, and a first protrusion. The fixed contact is disposed on the first terminal portion. The second terminal portion extends from a first end of both ends of the first terminal portion. The fixed terminal is bent between the second terminal portion and the first terminal portion. The first protrusion is disposed on the second terminal portion. The movable contact piece includes a movable contact. The movable contact faces the fixed contact. The support portion includes a contact surface and a first side surface and supports the fixed terminal. The contact surface contacts a first terminal surface of the first terminal portion opposite to the movable contact piece. The first side surface includes a first groove into which the first protrusion is fitted. The first protrusion is disposed on a second terminal surface connected to the first terminal surface in the second terminal portion.

In this manner, the fixed terminal includes the first protrusion and the support portion includes the first groove into which the first protrusion is fitted, thereby reducing a positional deviation of the fixed terminal in a width direction. The support portion contacts the first terminal portion, thereby regulating a position of the fixed terminal in a direction in which the movable contact and the fixed contact face each other.

The first protrusion and the first groove are disposed in a space opposite to the movable contact using the fixed terminal as a reference. As a result, it is possible to reduce a positional deviation of fixed terminal without reducing the space where the movable contact is disposed by separately providing a regulating portion configured to regulate a positional deviation of the fixed terminal.

Even when a material forming the support portion is shaved by the first protrusion in the first groove, it is possible to reduce the scattering of shavings to the outside of the first groove by covering the first groove with the fixed terminal.

The first protrusion and the first groove are disposed in a space opposite to the movable contact using the fixed terminal as a reference, thereby reducing a positional deviation of the fixed terminal in a state where behavior of arc is easily controlled without hindering movement of the arc.

The first groove may be formed in a direction in which the second terminal portion extends from the first end of the first terminal portion. The first groove may include an opening that opens toward the contact surface. The first protrusion is to be inserted into the opening. In this case, the first protrusion is inserted from the opening, thereby easily assembling the fixed terminal to the support portion.

The first groove may include a disposition portion, an opening side portion, and a connection portion. The first protrusion may be disposed in the disposition portion. The opening side portion may be disposed closer to the opening than the disposition portion and a width of the opening side portion may be larger than a width of the disposition portion. The connection portion may have a width that decreases from the opening side portion toward the disposition portion. In this case, the first protrusion can be easily inserted into the first groove.

The fixed terminal may further include a third terminal portion. The third terminal portion may extend from a second end of the first terminal portion parallel to the second terminal portion, the second end being opposite to the first end. In this case, it is possible to reduce a position deviation of the fixed terminal having a U-shape.

The fixed terminal may further include a second protrusion. The second protrusion may be disposed on a third terminal surface connected to the first terminal surface in the third terminal portion. The support portion may further include a second side surface. The second side surface may include a second groove into which the second protrusion of the third terminal portion is fitted. In this case, it is possible to reduce a positional deviation with the two protrusions and the two grooves.

The movable contact piece may be configured to move in a first direction including a contact direction in which the movable contact approaches the fixed contact and a separation direction in which the movable contact separates from the fixed contact. The electromagnetic relay may further include a magnet portion. The magnet portion is configured to generate a magnetic field to extend an arc generated between the fixed contact and the movable contact in a second direction orthogonal to the first direction. In this case, the protrusion and the groove are disposed in a space opposite to the movable contact using the fixed terminal as a reference, thereby reducing a positional deviation of the fixed terminal in a state where behavior of arc is easily controlled without hindering movement of the arc.

DETAILED DESCRIPTION

Hereinafter, embodiments of an electromagnetic relay according to one aspect of the present disclosure will be described with reference to the drawings. In each of the drawings, a direction indicated by Z2 is referred to as "up", a direction indicated by Z1 is referred to as "down", a direction indicated by X1 is referred to as "left", a direction indicated by X2 is referred to as "right", a direction indicated by Y1 is referred to as "front", and a direction indicated by Y2 is referred to as "back". These directions are defined for convenience of description and are not intended to limit the directions in which the electromagnetic relay is disposed.

<Configuration>

(Overview of Electromagnetic Relay 1)

Figure 1:
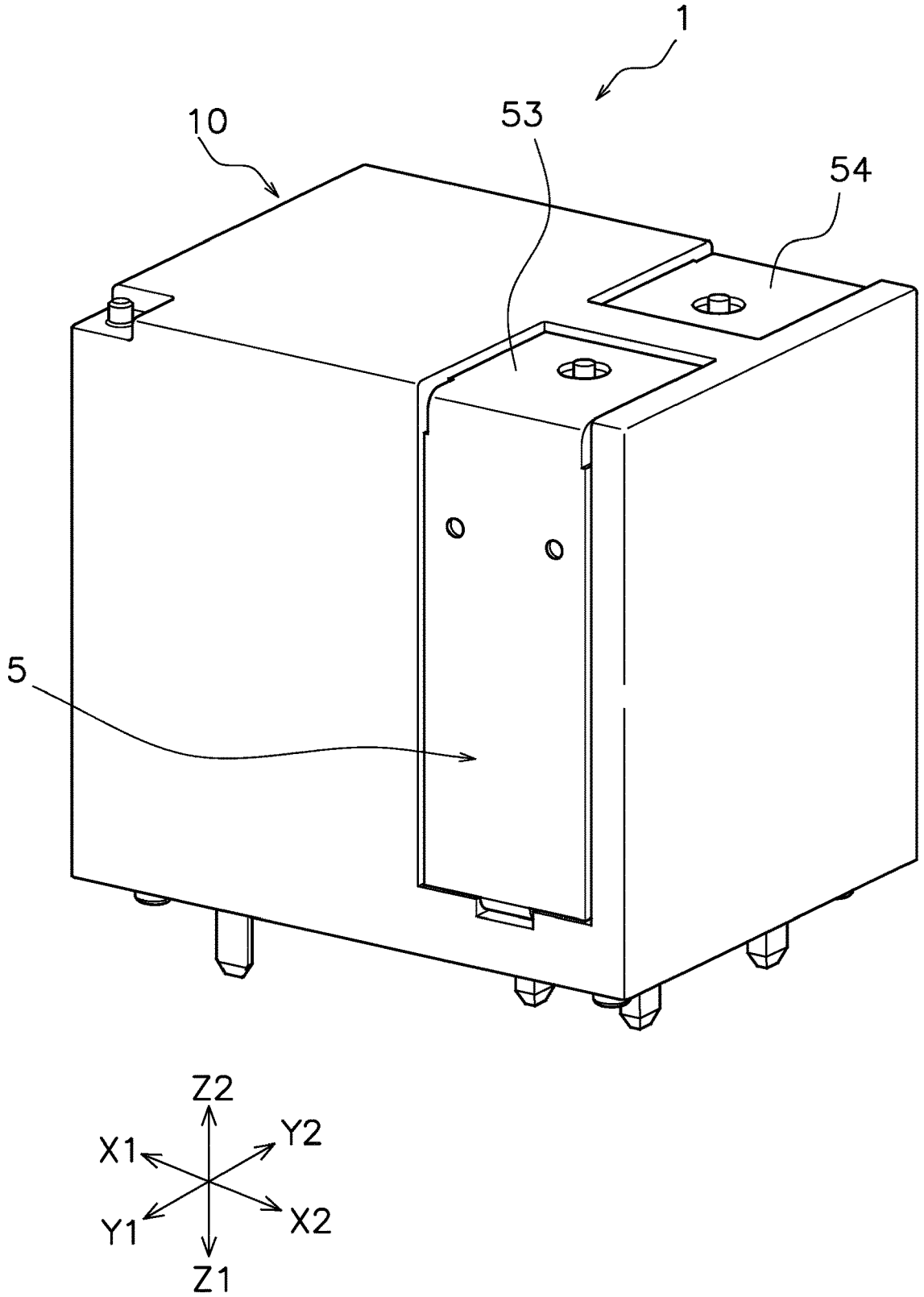
FIG. 1 is a perspective view of an electromagnetic relay.
Figure 2:
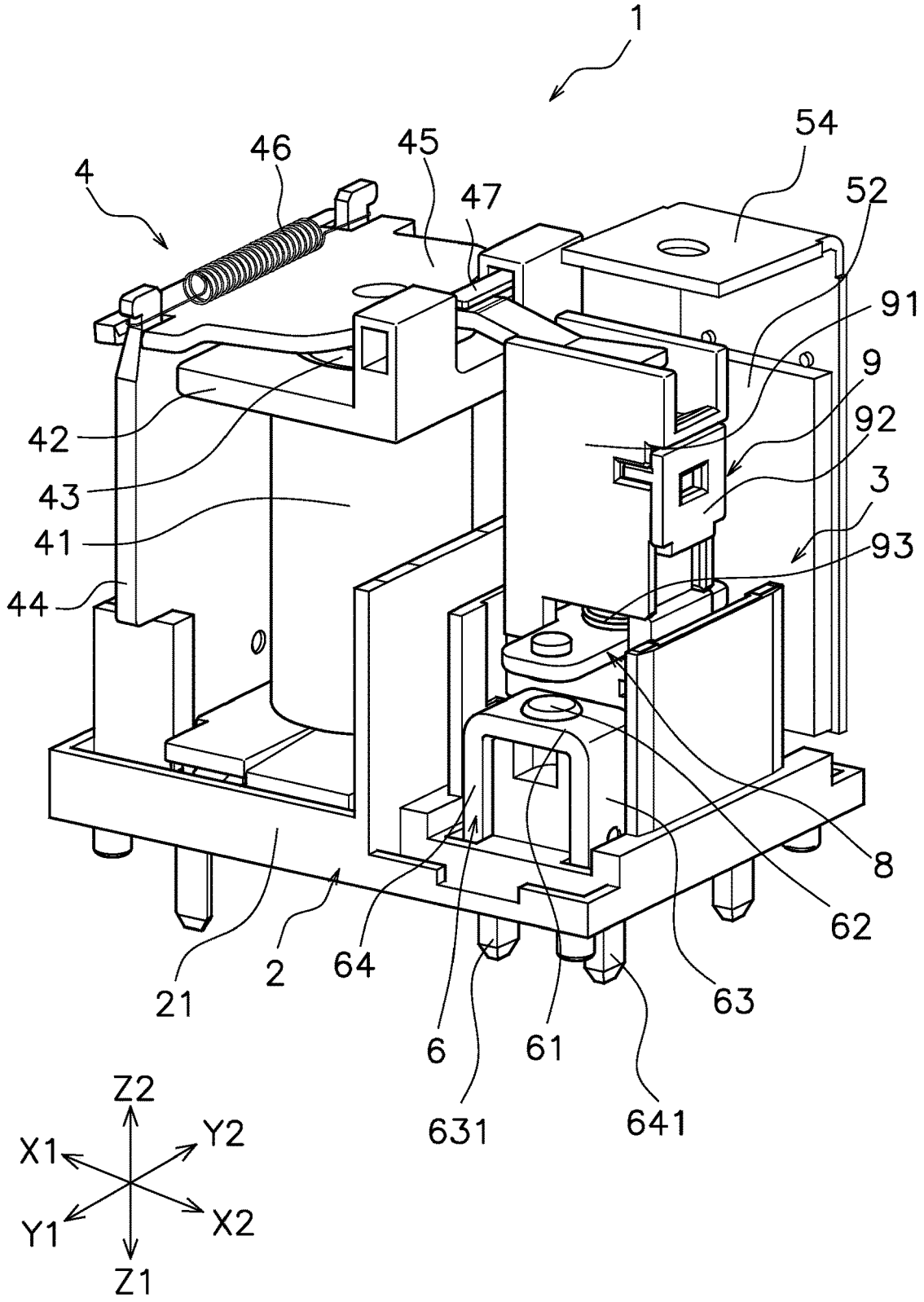
FIG. 2 is a perspective view illustrating an internal configuration of the electromagnetic relay.
Figure 3:
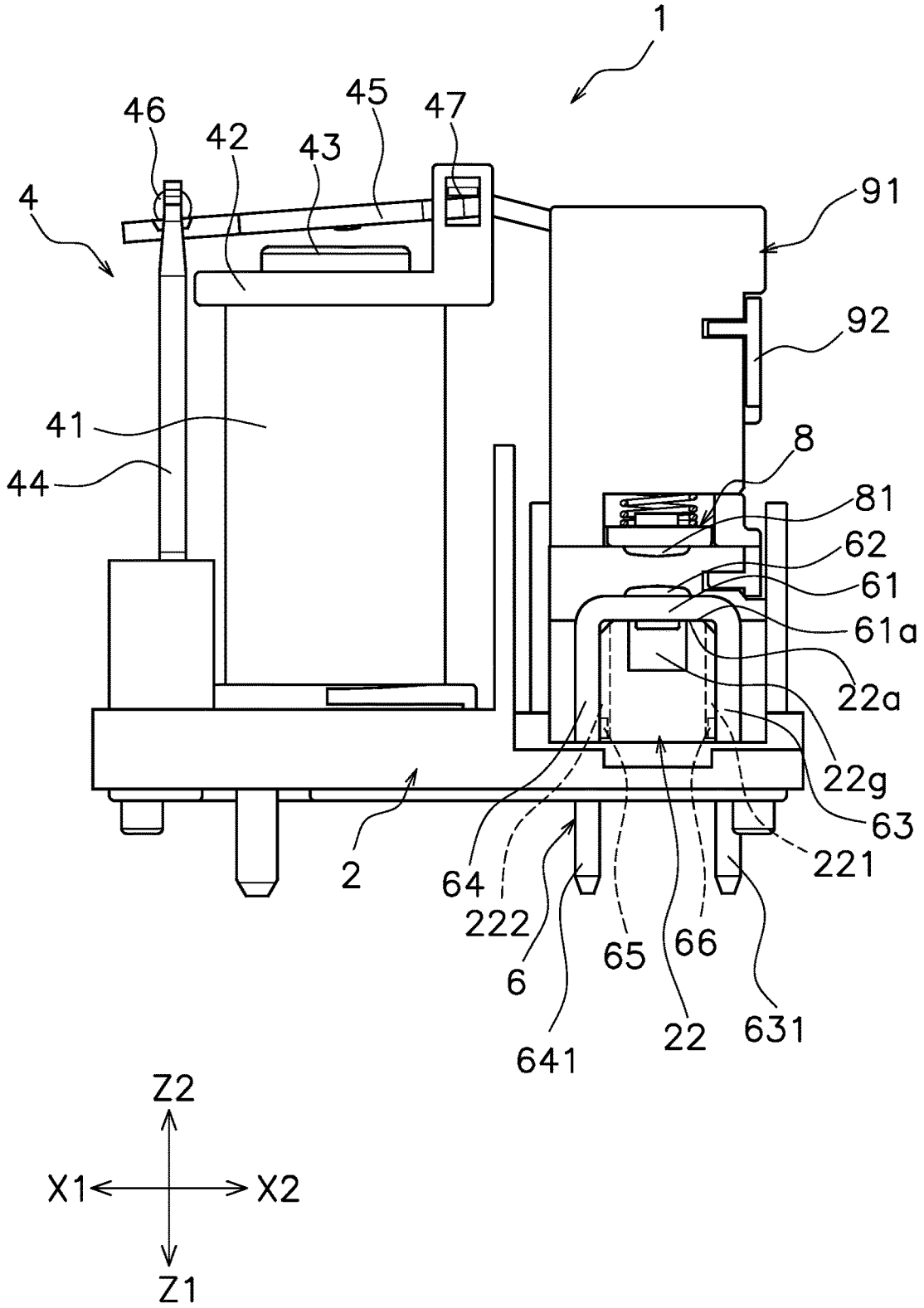
FIG. 3 is a front view of the internal configuration of the electromagnetic relay as viewed from the front.

FIG. 1 is a perspective view of an electromagnetic relay 1. FIG. 2 is a perspective view illustrating a state where a case is removed from the electromagnetic relay 1. FIG. 3 is a side view of FIG. 2.

As illustrated in FIGS. 1 to 3, the electromagnetic relay 1 includes a base 2, a case 10, a contact device 3, a drive device 4, and a magnet portion 5.

Figure 4:
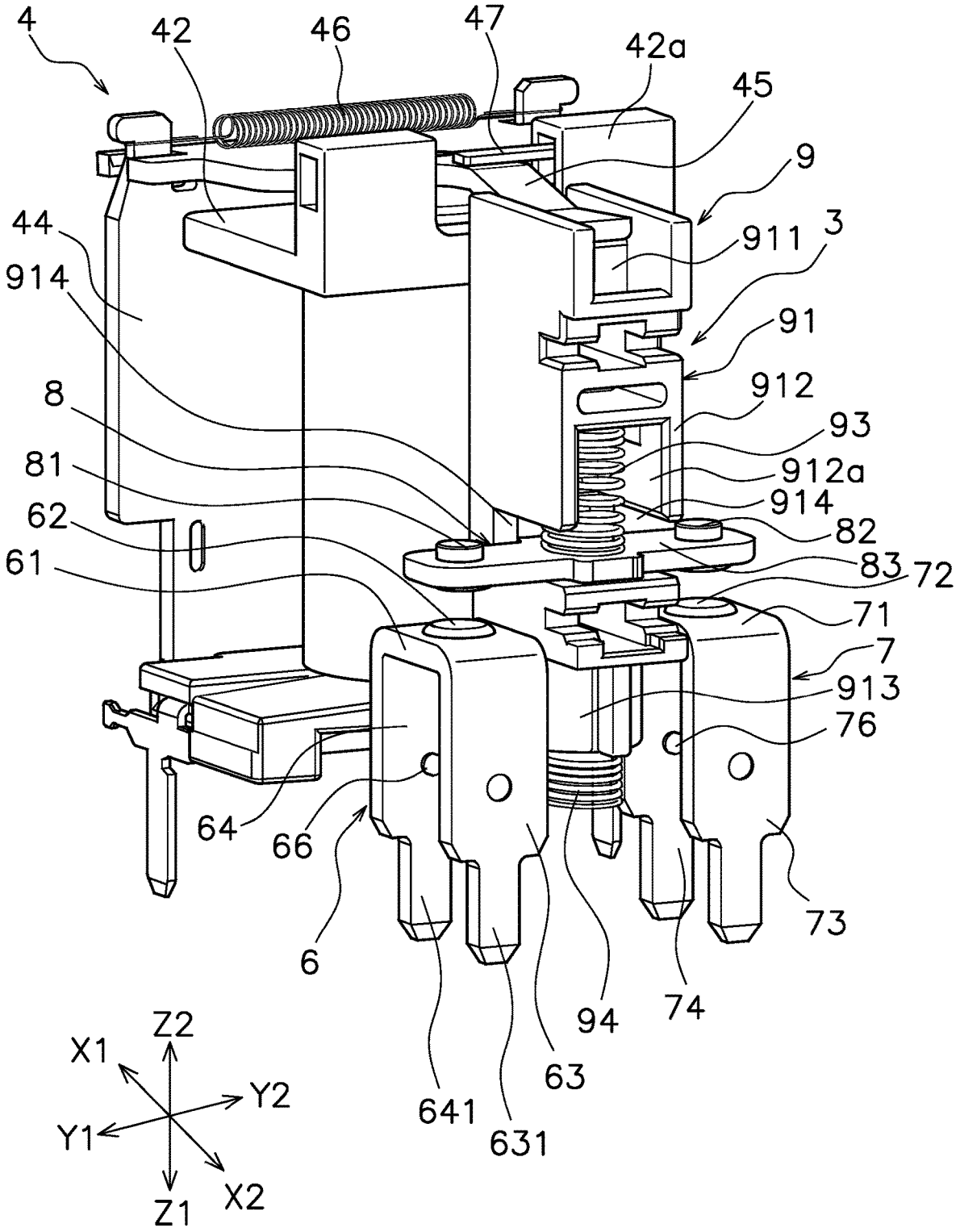
FIG. 4 is a perspective view of a contact device and a drive device as viewed from the front.

The base 2 is made from an insulating material such as resin. The base 2 supports the contact device 3 and the drive device 4. The contact device 3 and the drive device 4 are covered with the case 10 attached to the base 2. As illustrated in FIG. 4 described later, the contact device 3 includes two fixed terminals, i.e., a first fixed terminal 6 and a second fixed terminal 7, and a movable contact piece 8 that is configured to interconnect the first fixed terminal 6 and the second fixed terminal 7. The drive device 4 moves the movable contact piece 8 so that the movable contact piece 8 contacts the first fixed terminal 6 and the second fixed terminal 7 or separates from the first fixed terminal 6 and the second fixed terminal 7. The magnet portion 5 extends an arc generated with the separation of contacts by the Lorentz force.

(Contact Device 3)

FIG. 4 is a perspective view of the contact device 3 and the drive device 4 as viewed from the front.

The contact device 3 includes the first fixed terminal 6 (an example of a fixed terminal), the second fixed terminal 7 (an example of a fixed terminal), the movable contact piece 8, and a movable unit 9. The first fixed terminal 6, the second fixed terminal 7, and the movable contact piece 8 are terminals having a plate shape and are made from a conductive material such as copper. The first fixed terminal 6 and the second fixed terminal 7 are fixed to the base 2. The movable contact piece 8 is configured to contact the first fixed terminal 6 and the second fixed terminal 7 or separate from the first fixed terminal 6 and the second fixed terminal 7. The movable unit 9 moves the movable contact piece 8 between a contact position where the movable contact piece 8 contacts the first fixed terminal 6 and the second fixed terminal 7 and a separation position where the movable contact piece 8 separates from the first fixed terminal 6 and the second fixed terminal 7.

(First Fixed Terminal 6 and Second Fixed Terminal 7)

As illustrated in FIGS. 2 and 3, the first fixed terminal 6 has a shape bent in a U-shape when viewed from the front-back direction. The first fixed terminal 6 is disposed on the base 2. The disposition of the first fixed terminal 6 with respect to the base 2 will be described later.

As illustrated in FIG. 3, the first fixed terminal 6 includes a contact support portion 61 (an example of a first terminal portion), a first fixed contact 62, and a pair of first external connection portion 63 (an example of a second terminal portion) and a second external connection portion 64 (an example of a third terminal portion), a first protrusion 65, and a second protrusion 66.

The contact support portion 61 includes a flat surface orthogonal to the up-down direction. The first fixed contact 62 is supported by the contact support portion 61. The first fixed contact 62 protrudes upward from the contact support portion 61. The first fixed contact 62 may be integrated with the contact support portion 61, the first external connection portion 63, and the second external connection portion 64. As described later in detail, as illustrated in FIG. 3, the base 2 contacts a surface 61*a* (an example of a first terminal surface) of the contact support portion 61 opposite to the movable contact piece 8.

Figure 5:
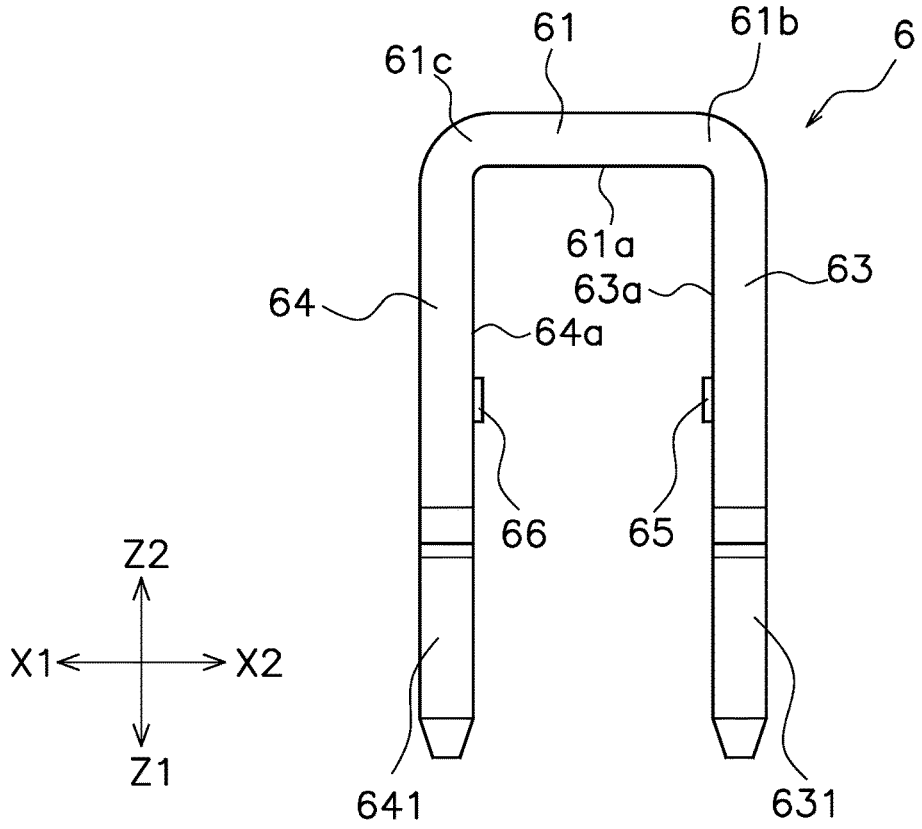
FIG. 5 is a front view of a first fixed terminal as viewed from the front.
Figure 6:
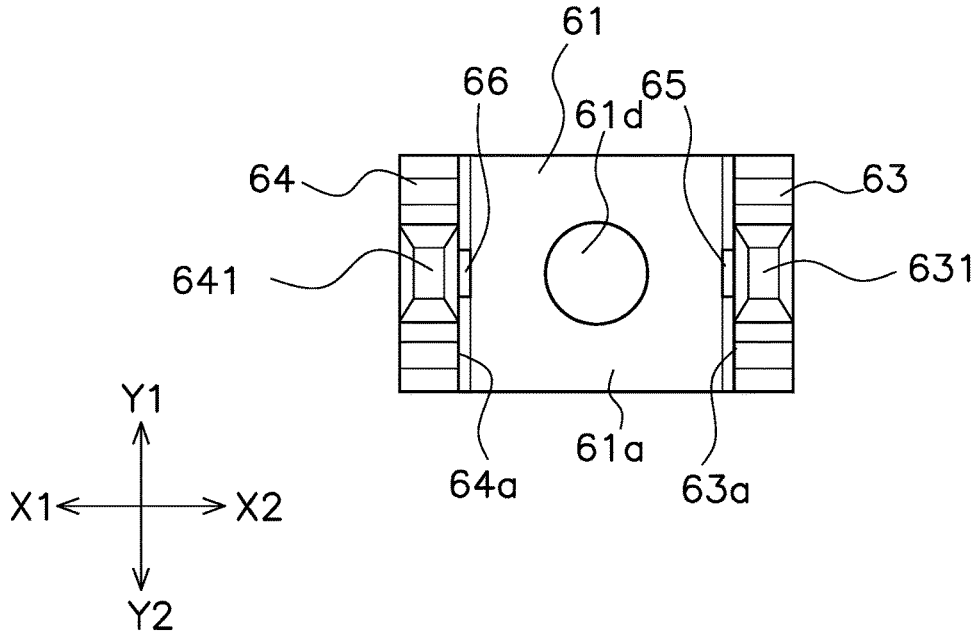
FIG. 6 is a bottom view of the first fixed terminal as viewed from below.

FIG. 5 is a view of the first fixed terminal 6 as viewed from the front. FIG. 6 is a view of the first fixed terminal 6 as viewed from below. In FIGS. 5 and 6, the first fixed contact 62 is omitted.

As illustrated in FIG. 5, the first external connection portion 63 extends downward from a right end 61*b* (an example of a first end) of both ends of the contact support portion 61 in the left-right direction at angles with respect to the contact support portion 61. The first fixed terminal 6 is bent between the first external connection portion 63 and the contact support portion 61. As illustrated in FIG. 4, the first external connection portion 63 includes a tip 631 having a narrower width and protruding downward from the base 2.

As illustrated in FIG. 5, the second external connection portion 64 extends downward from a left end 61*c* (an example of a second end) of both ends of the contact support portion 61 in the left-right direction at angles with respect to the contact support portion 61. The first fixed terminal 6 is bent between the second external connection portion 64 and the contact support portion 61. As illustrated in FIG. 4, the second external connection portion 64 includes a tip 641 having a narrower width and protruding downward from the base 2.

The first external connection portion 63 and the second external connection portion 64 are disposed facing each other in the left-right direction. The first external connection portion 63 and the second external connection portion 64 are disposed parallel to each other. The tips 631 and 641 protruding from the base 2 (see FIG. 3) are electrically connected to an external device (not illustrated). The terms of "parallel" and "vertical" used in this specification include a mechanical error and a range generally accepted as parallel and vertical.

As illustrated in FIGS. 5 and 6, the first external connection portion 63 includes a surface 63*a* (an example of a second terminal surface) connected to the surface 61*a* of the contact support portion 61. The first protrusion 65 is disposed on the surface 63*a*. The first protrusion 65 has, for example, a cylindrical shape. The first protrusion 65 protrudes from the first external connection portion 63 in a direction in which the contact support portion 61 extends (the left direction). The first protrusion 65 is formed toward the second external connection portion 64. The first protrusion 65 is disposed closer to the contact support portion 61 than the tip 631.

The second external connection portion 64 includes a surface 64*a* (an example of a third terminal surface) connected to the surface 61*a* of the contact support portion 61. The second protrusion 66 is disposed on the surface 64*a*. The second protrusion 66 has, for example, a cylindrical shape. The second protrusion 66 protrudes from the second external connection portion 64 in a direction in which the contact support portion 61 extends (the right direction). The second protrusion 66 is formed toward the first external connection portion 63. The second protrusion 66 is disposed closer to the contact support portion 61 than the tip 641.

The first protrusion 65 and the second protrusion 66 are disposed facing each other. The first protrusion 65 and the second protrusion 66 are positioned inside the U-shape of the first fixed terminal 6 bent in a U-shape.

As illustrated in FIG. 4, the second fixed terminal 7 is supported by the base 2 at a position apart from the first fixed terminal 6 in the front-back direction. The second fixed terminal 7 is disposed behind the first fixed terminal 6 and apart from the first fixed terminal 6. The second fixed terminal 7 has a same shape as the first fixed terminal 6. As illustrated in FIG. 4, the second fixed terminal 7 includes a contact support portion 71, a second fixed contact 72, a pair of a first external connection portions 73 and a second external connection portion 74, a first protrusion (not illustrated) and a second protrusion 76. The second fixed terminal 7 has a same configuration as the first fixed terminal 6, and therefore the description thereof is omitted.

(Movable Contact Piece 8)

As illustrated in FIG. 4, the movable contact piece 8 extends in the front-back direction. The movable contact piece 8 is coupled to the movable unit 9. The movable contact piece 8 is disposed above the first fixed terminal 6 and the second fixed terminal 7.

The movable contact piece 8 includes a contact support member 83 and a pair of a first movable contact 81 and a second movable contact 82. The contact support member 83 has a plate shape and extends in the front-back direction.

The first movable contact 81 is disposed on a front end portion of the contact support member 83. The first movable contact 81 is disposed above and facing the first fixed contact 62. The first movable contact 81 is configured to contact the first fixed contact 62.

The second movable contact 82 is disposed on a back end portion of the contact support member 83. The second movable contact 82 is disposed above and facing the second fixed contact 72. The second movable contact 82 is configured to contact the second fixed contact 72. The first movable contact 81 and the second movable contact 82 may be integrated with the contact support member 83.

The movable contact piece 8 is configured to move in a first direction. The first direction includes a contact direction in which the first movable contact 81 and the second movable contact 82 approach the first fixed contact 62 and the second fixed contact 72 and a separation direction in which the first movable contact 81 and the second movable contact 82 separate from the first fixed contact 62 and the second fixed contact 72. In the present embodiment, the first direction is the up-down direction, the contact direction is the direction indicated by Z1 (the down direction) and the separation direction is the direction indicated by Z2 (the up direction).

The movable contact piece 8 is configured to move between an open position where the pair of the first movable contact 81 and the second movable contact 82 separates from the first fixed contact 62 and the second fixed contact 72 and a closed position where the pair of the first movable contact 81 and the second movable contact 82 contact the first fixed contact 62 and the second fixed contact 72.

(Movable Unit 9)

As illustrated in FIG. 4, the movable unit 9 extends in the up-down direction. The movable unit 9 is coupled to the movable contact piece 8 between the first movable contact 81 and the second movable contact 82. The movable unit 9 is disposed at the center of the movable contact piece 8 in the front-back direction.

As illustrated in FIGS. 2 and 4, the movable unit 9 includes a movable member 91, a cover member 92, a contact spring 93, and a return spring 94. The movable member 91 extends in the up-down direction. The movable member 91 and the cover member 92 are made from an insulating material such as resin.

The movable member 91 includes a pressed part 911, a disposition part 912, and a sliding part 913. The pressed part 911 is disposed on an upper part of the movable member 91. The pressed part 911 is a part pressed downward by a movable iron piece 45 of the drive device 4.

The disposition part 912 is a substantially center part of the movable member 91 in the up-down direction. The contact spring 93 and the movable contact piece 8 are disposed in the disposition part 912. The disposition part 912 has a disposition space 912*a* with its right side wall open and the contact spring 93 is disposed in the disposition space 912*a*. At a lower end of the disposition space 912*a*, a cutout 914 is formed in the side walls in the front-back direction. The movable contact piece 8 is disposed through the cutout 914 at the side walls of the disposition space 912*a* and the disposition space 912*a*.

The sliding part 913 is a lower end portion of the movable member 91. The sliding part 913 is guided by a guide portion 24 (see FIG. 8 described later) on the base 2. The guide portion 24 is recessed downward on the upper surface of the base 2. The sliding part 913 slides in the guide portion 24, thereby guiding the movable member 91.

As illustrated in FIGS. 2 and 3, the cover member 92 covers the right side of the disposition space 912*a*. The cover member 92 restricts the movable contact piece 8 from protruding rightward from the movable member 91.

As illustrated in FIG. 4, the contact spring 93 is a coil spring and is disposed in the disposition space 912*a* in the up-down direction. The upper end of the contact spring 93 is coupled to an upper surface of the disposition space 912*a*. The lower end of the contact spring 93 is coupled to the movable contact piece 8 between the first movable contact 81 and the second movable contact 82. The contact spring 93 is disposed between the upper surface of the disposition space 912*a* and the movable contact piece 8 in a compressed state. Accordingly, the contact spring 93 urges the movable contact piece 8 toward the contact direction. The movable contact piece 8 is pressed against a lower surface of the disposition space 912*a* by the contact spring 93.

The contact spring 93 is provided in order to increase contact pressure of the first movable contact 81 against the first fixed contact 62 and contact pressure of the second movable contact 82 against the second fixed contact 72.

The return spring 94 is disposed between the sliding part 913 of the movable member 91 and the guide portion 24 of the base 2. The return spring 94 urges the movable member 91 upward. The return spring 94 moves the movable member 91 upward when the movable member 91 is released from the pressing by the drive device 4. Accordingly, the movable contact piece 8 moves from the contact position to the separation position.

(Drive Device 4)

As illustrated in FIG. 2, the drive device 4 is disposed at the left side of the contact device 3. The drive device 4 moves the movable contact piece 8 in the up-down direction via the movable unit 9. As illustrated in FIGS. 2 and 3, the drive device 4 includes a coil 41, a bobbin 42, a fixed iron core 43, a yoke 44, a movable iron piece 45, a spring 46, and a stopper member 47.

The coil 41 is wound around the outer circumference of the bobbin 42. The bobbin 42 extends in the up-down direction. The bobbin 42 is fixed to the base 2. The fixed iron core 43 is disposed in the inner circumference of the bobbin 42. The yoke 44 has a substantially L-shape when viewed in the front-back direction and is disposed so as to cover the left side of the coil 41. The yoke 44 is connected to the lower end of the fixed iron core 43.

The movable iron piece 45 is disposed above the fixed iron core 43. The left end of the movable iron piece 45 is rotatably supported by the yoke 44. The movable iron piece 45 rotates while the upper end of the yoke 44 acts as a fulcrum. As illustrated in FIG. 4, a tip of the right end of the movable iron piece 45 contacts the pressed part 911 of the movable unit 9 from above.

The spring 46 is disposed at the upper end of the yoke 44 in the front-back direction. The spring 46 is disposed above the movable iron piece 45. The spring 46 urges the movable iron piece 45 in a direction in which the movable iron piece 45 separates from the fixed iron core 43.

The stopper member 47 is attached to an attachment portion 42*a* formed upward from the right end of the bobbin 42. The stopper member 47 has a plate shape and is disposed in the front-back direction. The stopper member 47 is disposed above the movable iron piece 45. The stopper member 47 restricts the upward movement of the movable iron piece 45 due to the urging force of the spring 46 by a predetermined amount or more.

(Magnet Portion 5)

The magnet portion 5 generates a magnetic field to extend an arc generated between the first fixed contact 62 and the first movable contact 81 and an arc generated between the second fixed contact 72 and the second movable contact 82 in the front-back direction. The magnet portion 5 is disposed around the case 10.

Figure 7:
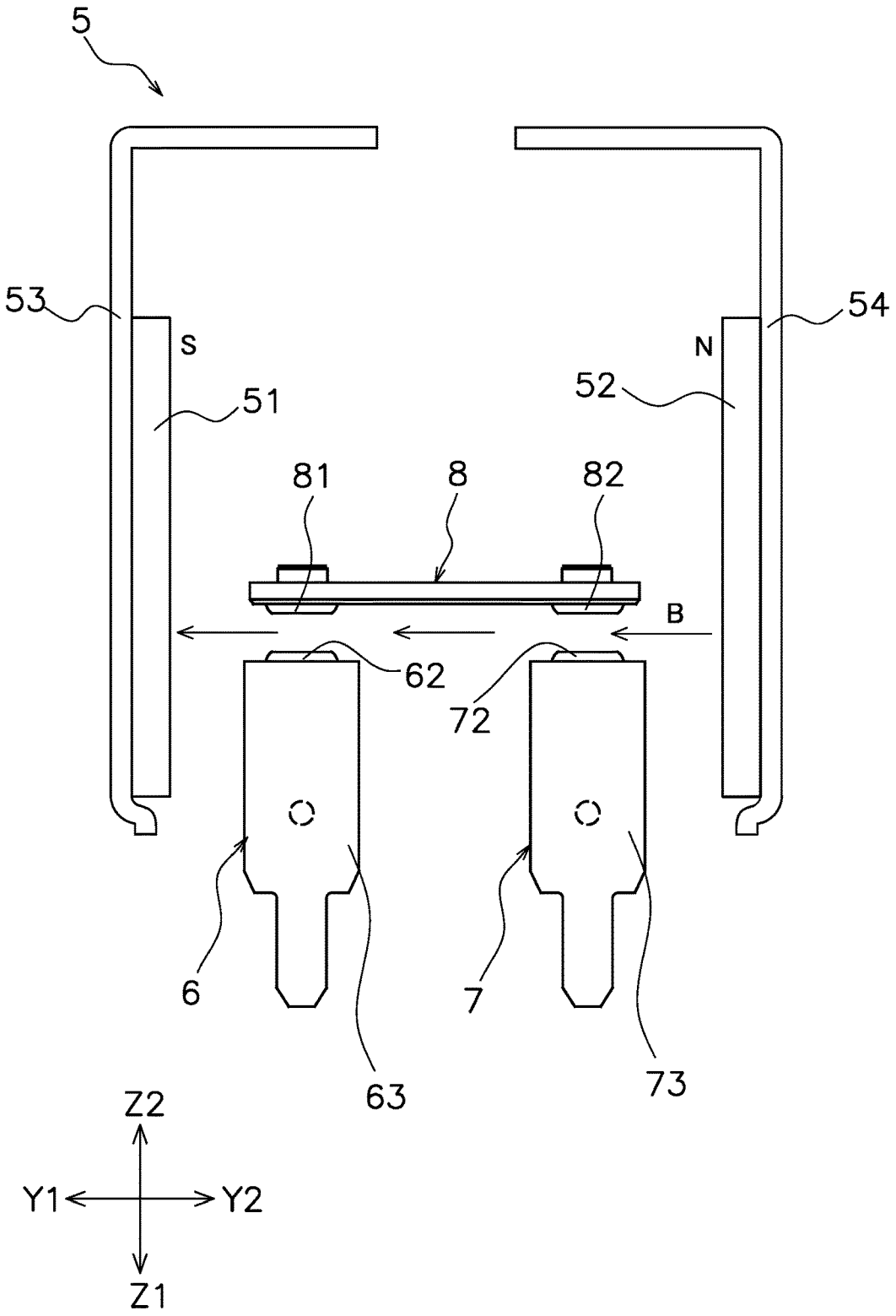
FIG. 7 is a diagram illustrating a positional relationship between a magnet portion and a movable contact piece, the first fixed terminal, and a second fixed terminal.

FIG. 7 is a diagram illustrating a disposition relationship between the magnet portion 5 and the first fixed contact 62, the second fixed contact 72, the first movable contact 81 and the second movable contact 82. FIG. 7 is the diagram as viewed from the right.

The magnet portion 5 includes a first magnet 51, a second magnet 52, a first yoke 53, and a second yoke 54. The first magnet 51 and the second magnet 52 are permanent magnets. The first magnet 51 is disposed on the front surface of the case 10. The first magnet 51 is disposed in front of the contact device 3. The second magnet 52 is disposed on the back surface of the case 10. The second magnet 52 is disposed behind the contact device 3. The second magnet 52 and the first magnet 51 are disposed so that the opposite poles thereof face each other in the front-back direction with the movable contact piece 8 in between. For example, the south pole of the first magnet 51 is disposed facing the movable contact piece 8 and the north pole of the second magnet 52 is disposed facing the movable contact piece 8. As a result, a magnetic flux flows between the first magnet 51 and the second magnet 52 from the second magnet 52 toward the first magnet 51 (see arrow B).

As illustrated in FIGS. 1 and 7, the first yoke 53 has a substantially L-shape when viewed in the left-right direction and is attached to the case 10. The first yoke 53 is connected to the first magnet 51 so as to cover the outer side (front side) and the upper side of the first magnet 51. As illustrated in FIGS. 1 and 7, the second yoke 54 has a substantially L-shape when viewed in the left-right direction and is attached to the case 10. The second yoke 54 is connected to the second magnet 52 so as to cover the outer side (back side) and the upper side of the second magnet 52. In FIG. 2, only the second magnet 52 and the second yoke 54 at the back side are illustrated and the first magnet 51 and the first yoke 53 at the front side are omitted.

Due to the magnet portion 5 described above, the arc generated between the first fixed contact 62 and the first movable contact 81 and the arc generated between the second fixed contact 72 and the second movable contact 82 extend in the front-back direction (an example of a second direction).

(Base 2)

Figure 8:
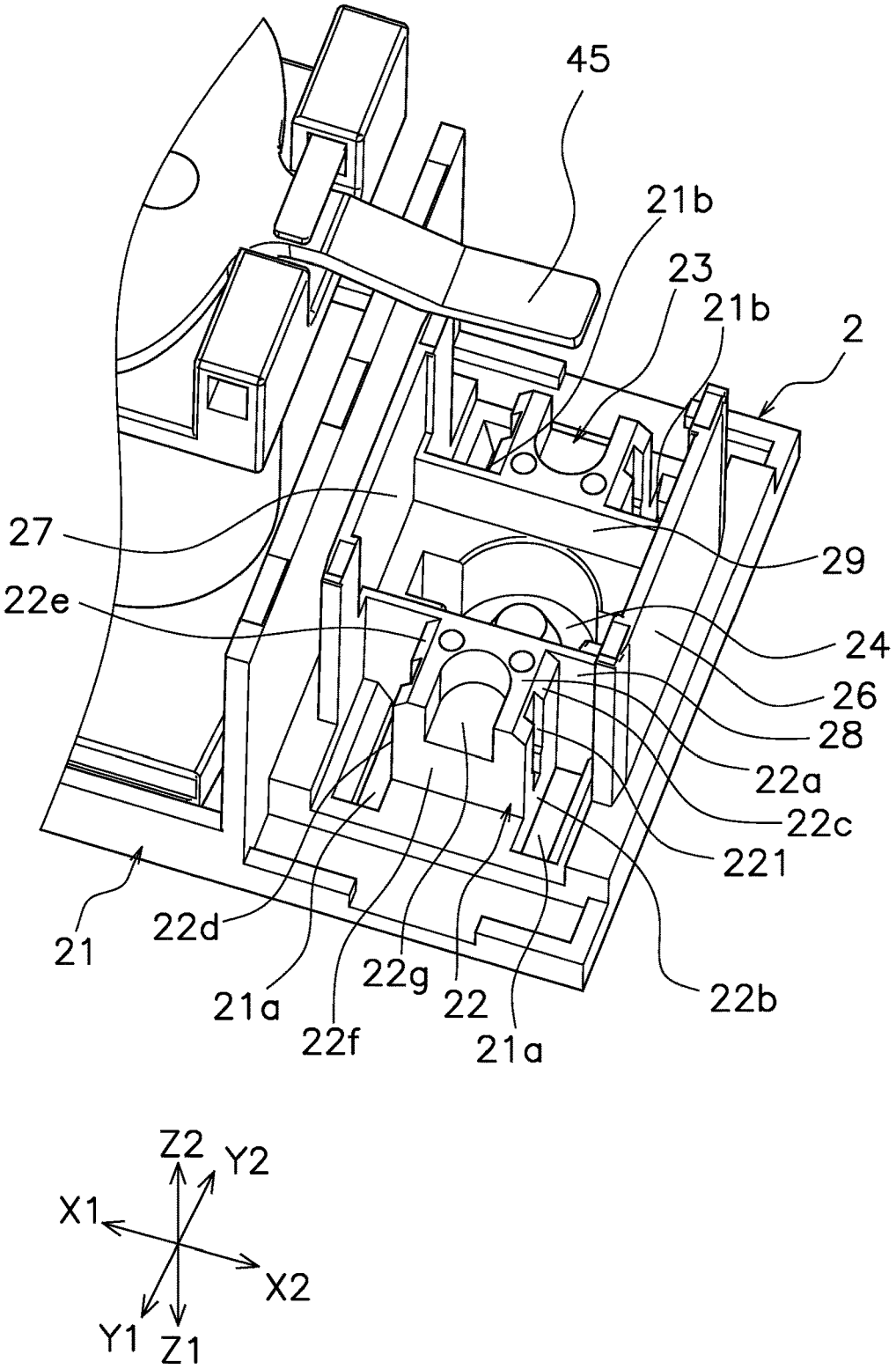
FIG. 8 is a partial perspective view of a base as viewed from above.

FIG. 8 is a perspective view illustrating a state where the first fixed terminal 6, the second fixed terminal 7, the movable contact piece 8, and the movable unit 9 are removed from the base 2.

The base 2 includes a bottom surface 21, a pair of first terminal support portion 22 (an example of the support portion) and second terminal support portion 23 (an example of the support portion).

The case 10 is attached to the bottom surface 21. As illustrated in FIG. 2, the drive device 4 is mounted on the bottom surface 21. As illustrated in FIG. 8, the guide portion 24 in which the sliding part 913 of the movable member 91 slides is disposed on the center of the right end of the bottom surface 21. A pair of walls 26 and 27 is upwardly formed at the left and right sides of the guide portion 24. A pair of walls 28 and 29 is upwardly formed at the front and back sides of the guide portion 24. The guide portion 24 is surrounded by the walls 26, 27, 28, and 29.

The first terminal support portion 22 supports the first fixed terminal 6. The second terminal support portion 23 supports the second fixed terminal 7. The first terminal support portion 22 and the second terminal support portion 23 are disposed in the vicinity of the right end of the bottom surface 21. The first terminal support portion 22 and the second terminal support portion 23 are disposed facing each other in the front-back direction with the guide portion 24 in between. The first terminal support portion 22 is integrally formed with the wall 28 at the front side of the wall 28. The second terminal support portion 23 is integrally formed with the wall 29 at the back side of the wall 29.

Through holes 21*a* into which the tips of the first fixed terminal 6 are inserted are formed in the bottom surface 21 at the left and right sides of the first terminal support portion 22. Through hole 21*b* into which the tips of the second fixed terminal 7 are inserted are formed in the bottom surface 21 at the left and right sides of the second terminal support portion 23.

The first terminal support portion 22 and the second terminal support portion 23 are disposed symmetrically in the front-back direction, and therefore the first terminal support portion 22 will be described as an example.

Figure 9:
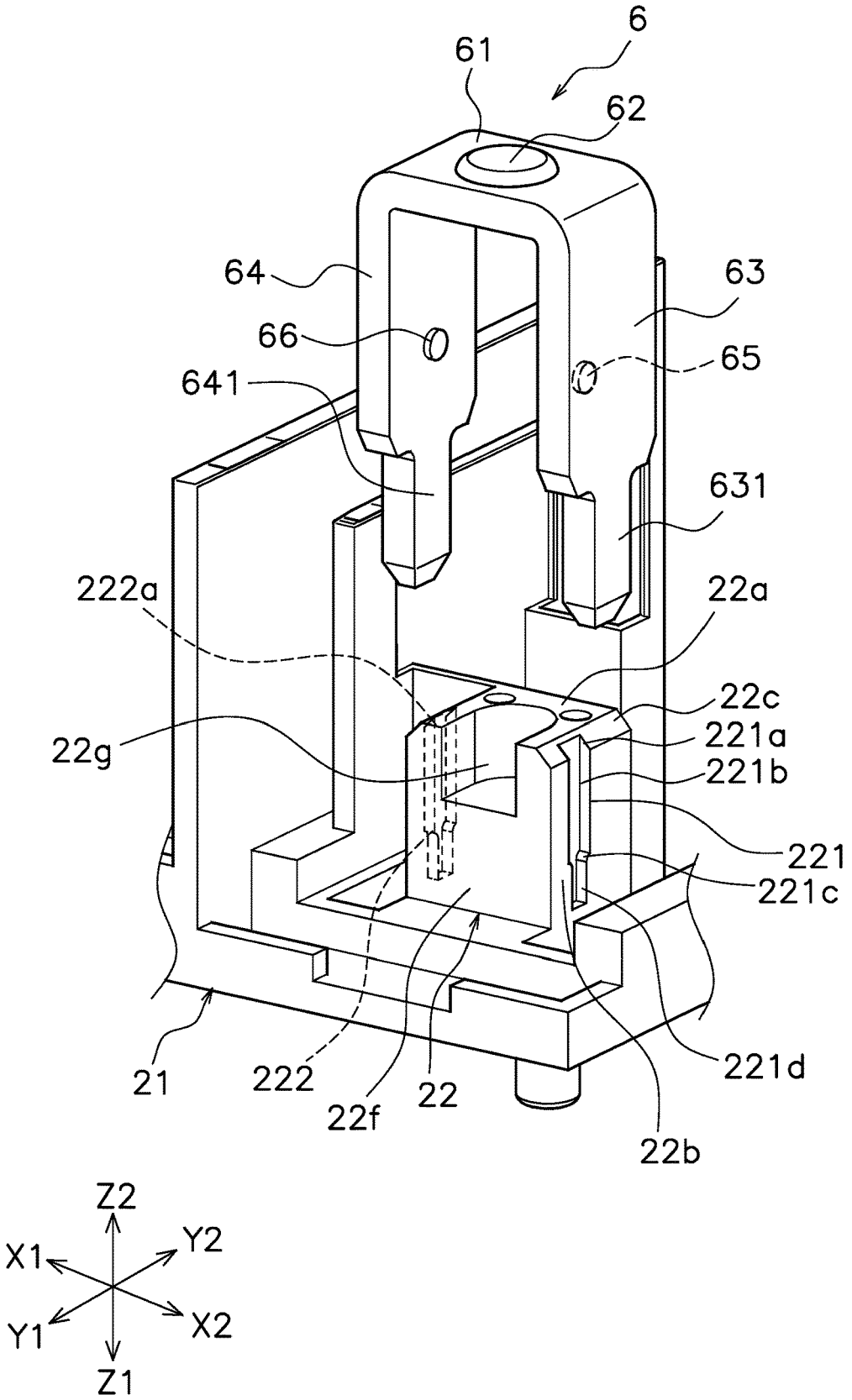
FIG. 9 is a view illustrating attachment of the first fixed terminal to a first terminal support portion.
Figure 10:
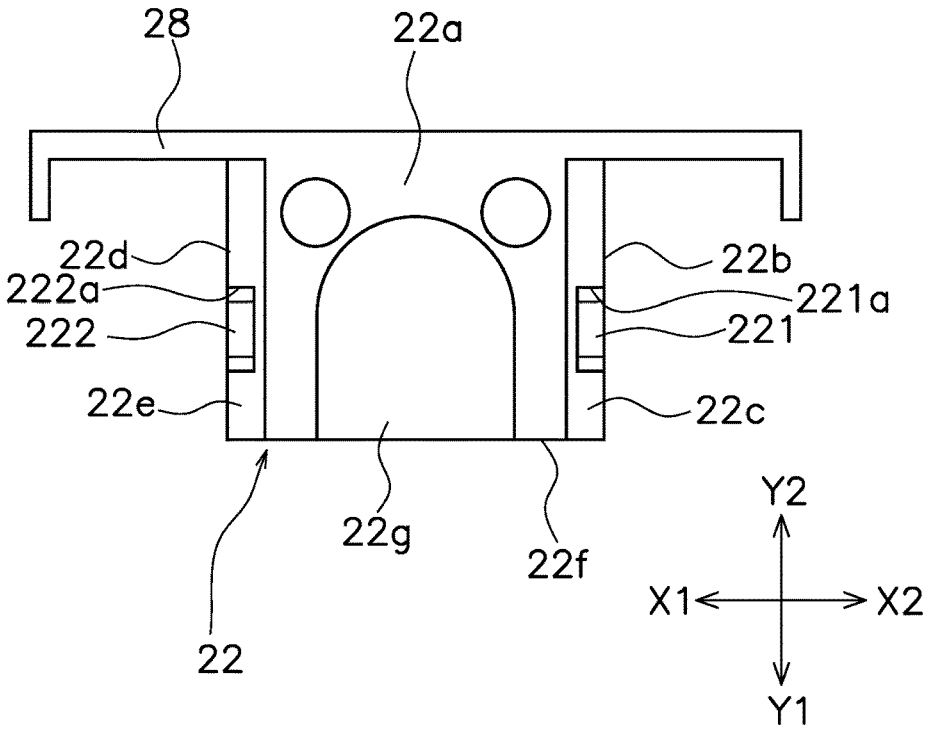
FIG. 10 is a plan view of the first terminal support portion as viewed from above.
Figure 11:
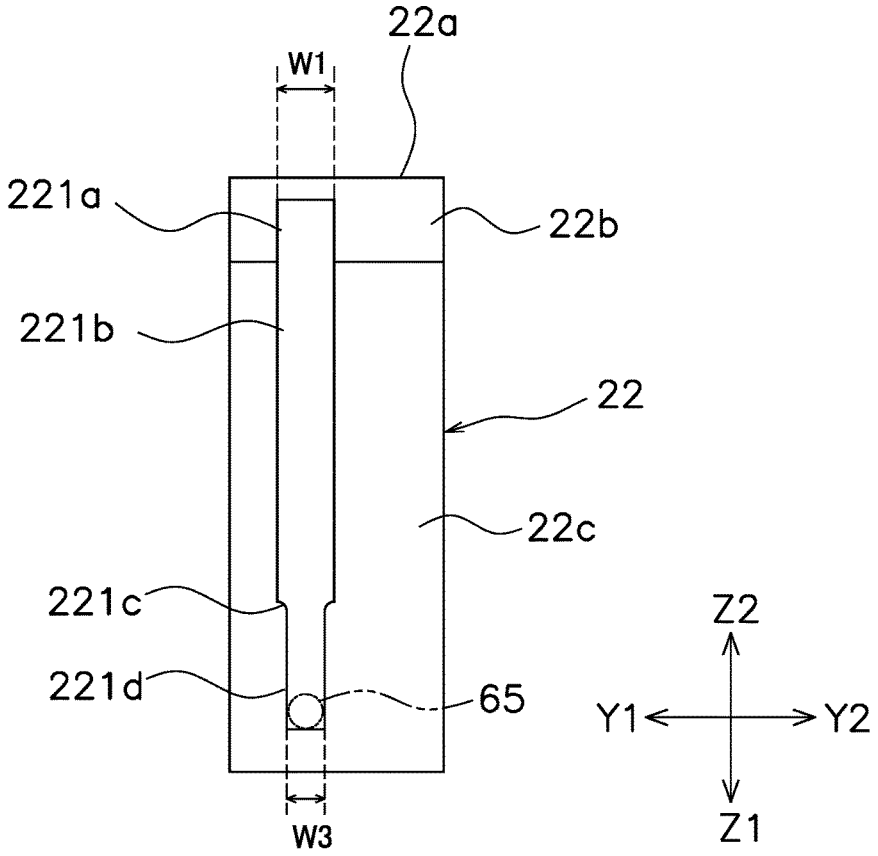
FIG. 11 is a side view of the first terminal support portion as viewed from the right.

FIG. 9 is an exploded perspective view of the first terminal support portion 22 and the first fixed terminal 6. FIG. 10 is a plan view of the first terminal support portion 22 as viewed from above. FIG. 11 is a side view of the first terminal support portion 22 as viewed from the right.

The first terminal support portion 22 is disposed so as to protrude upward from the bottom surface 21. The first terminal support portion 22 is fitted inside the U-shape of the first fixed terminal 6.

The first terminal support portion 22 has a substantially rectangular parallelepiped shape. As illustrated in FIGS. 8 and 10, the first terminal support portion 22 includes a contact surface 22*a*, a first side surface 22*b*, a first inclined surface 22*c*, a second side surface 22*d*, a second inclined surface 22*e*, and a third side surface 22*f*.

The contact surface 22*a* is a surface perpendicular to the up-down direction. The contact surface 22*a* contacts the surface 61*a* of the contact support portion 61 of the first fixed terminal 6 when the first fixed terminal 6 is attached to the first terminal support portion 22 (see FIG. 3).

The first side surface 22*b* is the right side surface of the first terminal support portion 22. The first side surface 22*b* is perpendicular to the left-right direction. The first side surface 22*b* faces the first external connection portion 63 of the first fixed terminal 6 when the first fixed terminal 6 is attached to the first terminal support portion 22.

The first inclined surface 22*c* is disposed between the contact surface 22*a* and the first side surface 22*b*. The first inclined surface 22*c* is inclined to the lower right.

The second side surface 22*d* is the left side surface of the first terminal support portion 22. The second side surface 22*d* is perpendicular to the left-right direction. The second side surface 22*d* faces the second external connection portion 64 of the first fixed terminal 6 when the first fixed terminal 6 is attached to the first terminal support portion 22.

The second inclined surface 22*e* is disposed between the contact surface 22*a* and the second side surface 22*d*. The second inclined surface 22*e* is inclined to the lower left.

The third side surface 22*f* is disposed between the first side surface 22*b* and the second side surface 22*d*. The right end of the third side surface 22*f* is connected to the first side surface 22*b*. The left end of the third side surface 22*f* is connected to the second side surface 22*d*. The third side surface 22*f* is perpendicular to the front-back direction.

The contact surface 22*a* includes a recess 22*g*. The first fixed contact 62 is disposed in a through hole 61*d* formed in the contact support portion 61 (see FIG. 6), and a portion of the first fixed contact 62 that protrudes from the contact support portion 61 opposite to the first movable contact 81 is disposed in the recess 22*g* (see FIG. 3). The recess 22*g* extends to the third side surface 22*f*.

As illustrated in FIGS. 9 and 11, the first side surface 22*b* includes a first groove 221. The first groove 221 is formed in the up-down direction. The lower end of the first groove 221 is closed and the upper end of the first groove 221 is open at the first inclined surface 22*c*. The open part is indicated as an opening 221*a*. The first groove 221 includes a first groove portion 221*b* (an example of an opening side portion), a second groove portion 221*c* (an example of a connection portion), and a third groove portion 221*d* (an example of a disposition portion) from the top.

The upper end of the first groove portion 221*b* corresponds to the opening 221*a*. As illustrated in FIG. 11, a width W1 of the first groove portion 221*b* in the front-back direction is constant.

The third groove portion 221*d* is a portion on which the first protrusion 65 is disposed when the first fixed terminal 6 is attached to the first terminal support portion 22. In FIG. 11, the first protrusion 65 when the first fixed terminal 6 is attached to the first terminal support portion 22 is indicated by a chain double-dashed line. Although the first protrusion 65 is disposed in the vicinity of the lower end of the first groove 221, a position of the first fixed terminal 6 in the up-down direction is determined by the contact surface 22*a*, and thus the position of the first protrusion 65 is not limited to the vicinity of the lower end. As illustrated in FIG. 11, a width W3 of the third groove portion 221*d* in the front-back direction is constant. The width W3 of the third groove portion 221*d* in the front-back direction is slightly larger than the length of the first protrusion 65 on the first external connection portion 63 in the front-back direction.

The width W1 of the first groove portion 221*b* in the front-back direction is larger than the width W3 of the third groove portion 221*d* in the front-back direction. The second groove portion 221*c* connects the first groove portion 221*b* and the third groove portion 221*d*. The width of the second groove portion 221*c* gradually decreases from the first groove portion 221*b* toward the third groove portion 221*d*. In the present embodiment, the side walls of the second groove portion 221*c* have a curved shape, but may have a linear shape.

As illustrated in FIG. 9, the second side surface 22*d* includes a second groove 222 having an opening 222*a* in the second inclined surface 22*e*. The second groove 222 has a same shape as the first groove 221, and therefore the description thereof will be omitted.

When the first fixed terminal 6 is attached to the first terminal support portion 22, as illustrated in FIG. 9, the first fixed terminal 6 disposed above the first terminal support portion 22 moves downward with respect to the first terminal support portion 22. At this time, the first protrusion 65 on the first external connection portion 63 is inserted into the first groove 221 via the opening 221*a* and the second protrusion 66 on the second external connection portion 64 is inserted into the second groove 222 via the opening 222*a*. At the same time, the tips 631 and 641 are inserted into the through holes 21*a*.

Figure 12:
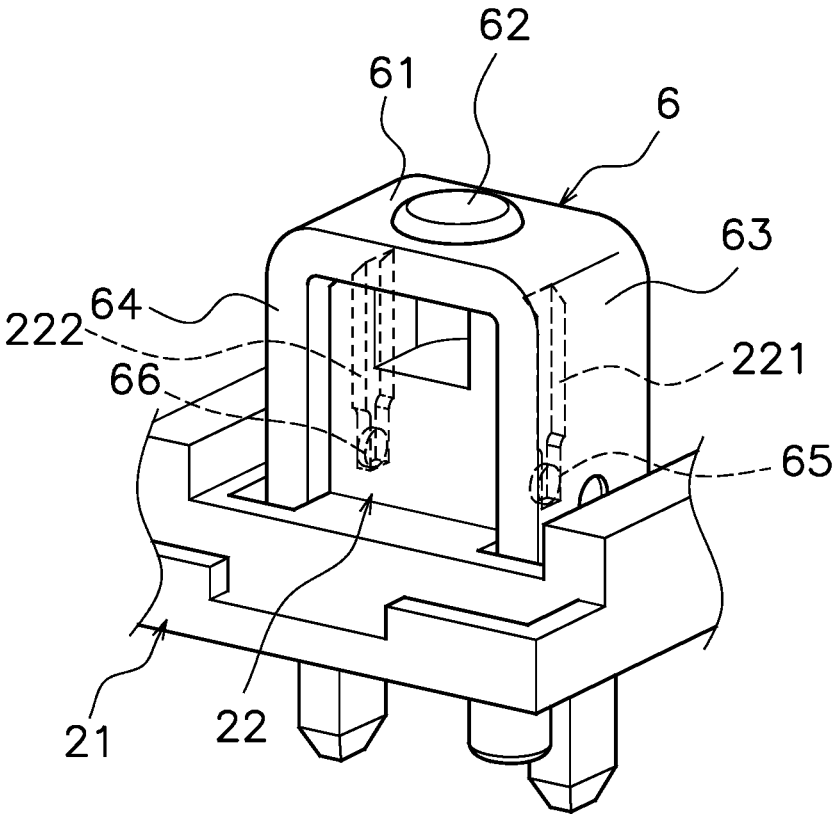
FIG. 12 is a view illustrating a state where the first fixed terminal is attached to the first terminal support portion.
Figure 12:
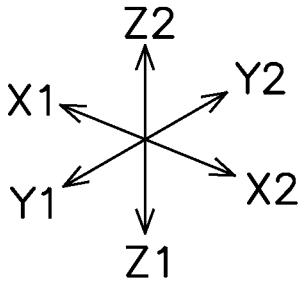

Then, the first fixed terminal 6 moves downward until the surface 61*a* of the contact support portion 61 of the first fixed terminal 6 contacts the contact surface 22*a* of the first terminal support portion 22. As a result, as illustrated in FIG. 12, the first fixed terminal 6 is attached to the first terminal support portion 22.

Similarly to the mentioned above, the second fixed terminal 7 is attached to the second terminal support portion 23.

<Operation>

Next, an operation of the electromagnetic relay 1 will be described.

In a state where no voltage is applied to the coil 41, the movable member 91 is pressed in the separation direction by elastic force of the return spring 94 and the movable contact piece 8 is positioned at the open position.

When a voltage is applied to the coil 41 and the drive device 4 is excited, the movable iron piece 45 is attracted to the fixed iron core 43 and rotates, whereby the movable member 91 is pressed in the contact direction. Accordingly, the movable member 91 moves in the contact direction against the elastic force of the return spring 94.

As the movable member 91 moves in the contact direction, the movable contact piece 8 moves to the closed position. Accordingly, the first movable contact 81 contacts the first fixed contact 62 and the second movable contact 82 contacts the second fixed contact 72. At this time, the movable contact piece 8 is urged in the contact direction by the contact spring 93, thereby sufficiently securing contact pressure of the first movable contact 81 against the first fixed contact 62 and contact pressure of the second movable contact 82 against the second fixed contact 72. When the application of the voltage to the coil 41 is stopped, the movable member 91 moves in the separation direction by the elastic force of the return spring 94 and the movable contact piece 8 returns to the open position.

In the embodiment described above, the first fixed terminal 6 includes the first protrusion 65 and the first terminal support portion 22 includes the first groove 221 into which the first protrusion 65 is fitted. As a result, even when external force is applied to a part of the first fixed terminal 6 exposed outside the case 10, it is possible to reduce a positional deviation of the first fixed terminal 6 in the width direction (the front-back direction). Further, a positional deviation of the first fixed terminal 6 in the up-down direction is regulated by the contact surface 22*a* of the first terminal support portion 22 contacting the surface 61*a* of the contact support portion 61 opposite to the movable contact piece 8.

As illustrated in the front view of FIG. 3, the first protrusion 65 and the first groove 221 are disposed in the space opposite to the movable contact piece 8 using the first fixed terminal 6 as a reference. As a result, it is possible to reduce a positional deviation of first fixed terminal 6 without reducing the space where the movable contact piece 8 is disposed by separately providing a regulating portion configured to regulate a positional deviation of the first fixed terminal 6.

Even when a material forming the first terminal support portion 22 is shaved by the first protrusion 65 in the first groove 221, it is possible to reduce the scattering of shavings to the outside of the first groove 221 by covering the first groove 221 with the first fixed terminal 6.

The first protrusion 65 and the first groove 221 are disposed in the space opposite to the movable contact piece 8 using the first fixed terminal 6 as a reference, whereby it is possible to easily control behavior of arc by the magnet portion 5 without hindering the movement of the arc.

The first groove 221 is formed in the direction (the down direction) in which the first external connection portion 63 extends from the end 61*b* of the contact support portion 61. The first groove 221 includes the opening 221*a* that opens at the end of both ends thereof closer to the contact surface 22*a*. The first protrusion 65 is to be inserted into the opening. As a result, the first protrusion 65 can be inserted from the opening 221*a*, thereby easily assembling the first fixed terminal 6 to the first terminal support portion 22.

The first groove 221 includes the third groove portion 221*d*, the first groove portion 221*b*, and the second groove portion 221*c*. The first protrusion 65 is disposed on the third groove portion 221*d*. The first groove portion 221*b* is disposed closer to the opening 221*a* than the third groove portion 221*d* and the width of the first groove portion 221*b* is larger than the width of the third groove portion 221*d*. The width of the second groove portion 221*c* decreases from the first groove portion 221*b* toward the third groove portion 221*d*. As a result, the first protrusion 65 can be easily inserted into the first groove 221.

The above-mentioned effects in the first protrusion 65 and the first groove 221 are also achieved in the second protrusion 66 and the second groove 222.

The above-mentioned effects in the configuration of the first terminal support portion 22 and the first fixed terminal 6 are also achieved in the configuration of the second terminal support portion 23 and the second fixed terminal 7.

The first fixed terminal 6 further includes the second external connection portion 64. The second external connection portion 64 extends from the end 61*c* of the contact support portion 61 parallel to the first external connection portion 63 and the end 61*c* is opposite to the end 61*b*. In such the first fixed terminal 6 having a U-shape, it is possible to reduce a positional deviation.

As illustrated in FIG. 5, the first fixed terminal 6 includes the second protrusion 66. The second protrusion 66 is disposed on the surface 64*a* connected to the surface 61*a* in the second external connection portion 64. The first terminal support portion 22 further includes the second side surface 22*d*. The second side surface 22*d* includes the second groove 222 into which the second protrusion 66 is fitted. In this case, it is possible to reduce a positional deviation with the two protrusions and the two grooves.

As illustrated in FIG. 3, the first protrusion 65 and the first groove 221 are disposed in the space opposite to the movable contact piece 8 using the first fixed terminal 6 as a reference. Further, the second protrusion 66 and the second groove 222 are disposed in the space opposite to the movable contact piece 8 using the first fixed terminal 6 as a reference. As a result, it is possible to reduce a positional deviation of the first fixed terminal 6 in a state where behavior of arc can be easily controlled without hindering movement of the arc by the magnet portion 5.

Other Embodiments

Although the embodiment of the electromagnetic relay according to one aspect of the present disclosure has been described above, the present disclosure is not limited to the above embodiment and various modifications can be made without departing from the gist of the present disclosure. For example, the configurations of the contact device 3 or the drive device 4 may be changed.

In the electromagnetic relay 1 of the above embodiment, the first fixed terminal 6 includes the first protrusion 65 and the second protrusion 66, but may include either one of them. In this case, only one groove to one protrusion may be provided.

As described above, even when only one set of the protrusion and the groove is provided, it is possible to reduce a positional deviation of the first fixed terminal 6 in the front-back direction.

Figure 13:
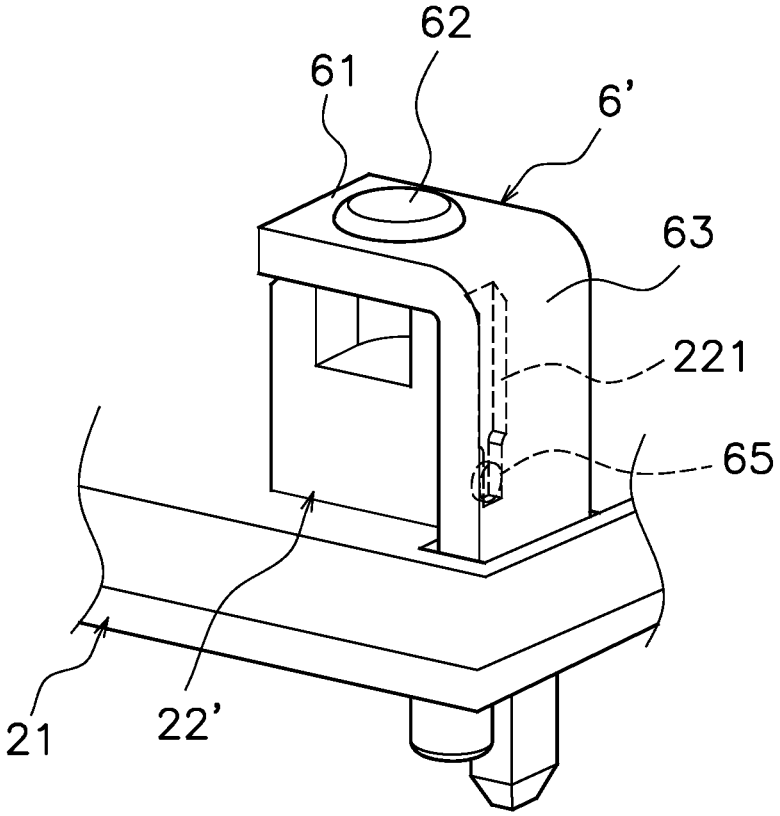
FIG. 13 is a view illustrating the fixed terminal having an L shape and a terminal support portion.
Figure 13:
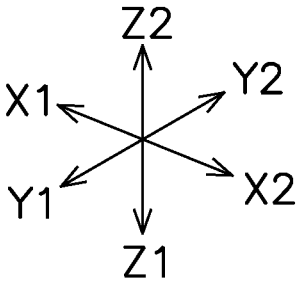

In the electromagnetic relay 1 of the above embodiment, the fixed terminal having a U-shape is used, but the shape is not limited to the U-shape and a fixed terminal having an L-shape may be used. FIG. 13 is a diagram illustrating a first fixed terminal 6' having an L-shape and a first terminal support portion 22' supporting the first fixed terminal 6'. The first fixed terminal 6' includes the contact support portion 61, the first fixed contact 62, the first external connection portion 63 and the first protrusion 65. However, unlike the first fixed terminal 6, the first fixed terminal 6' does not include the second external connection portion 64 or the second protrusion 66. Unlike the first terminal support portion 22, the first terminal support portion 22' does not include the second groove 222 in the second side surface 22*d* and only includes the first groove 221 in the first side surface 22*b*. The first protrusion 65 is fitted into the first groove 221. As a result, it is possible to regulate a positional deviation in the front-back direction.

In the electromagnetic relay 1 of the above embodiment, the first protrusion 65 and the second protrusion 66 have a cylindrical shape, but the shape is not limited to this and may have a polygonal pillar shape such as quadrangular prism.

In the electromagnetic relay 1 of the above embodiment, the first groove 221 and the second groove 222 are formed symmetrically in the front-back direction, but may not be formed symmetrically. For example, the back ends of the first groove portion 221*b*, the second groove portion 221*c*, and the third groove portion 221*d* may be formed linearly in the up-down direction, and the positions of their front ends may be different in each of the grooves.

In the first groove 221 of the electromagnetic relay 1 of the above embodiment, the width of the first groove portion 221*b* and the width of the third groove portion 221*d* are constant and the width of the first groove 221 decreases in the second groove portion 221*c*. However, the width of the first groove 221 may gradually decrease entirely. The width of the second groove 222 may gradually decrease entirely.

REFERENCE NUMERALS

1: Electromagnetic relay
6: First fixed terminal
8: Movable contact piece
22: First terminal support portion
22*a*: Contact surface
22*b*: First side surface
61: Contact support portion
61*a*: Surface
62: First fixed contact
63: First external connection portion
63*a*: Surface
65: First protrusion
221: First groove

The invention claimed is:

1. An electromagnetic relay, comprising:

a base including a support member and a first aperture disposed near a lower portion of the support member, the support member including an upper, contact-supporting surface and a first lateral side surface with a first groove that extends from near the upper, contact-supporting surface of the support member toward the first aperture, a fixed terminal that is bent to define a first terminal portion and a second terminal portion extending from a first end of the first terminal portion, the fixed terminal being supported by the support member with the first terminal portion disposed on the upper, contact-supporting surface of the support member in engagement therewith and the second terminal portion extending along the first lateral side surface of the support member in the same direction as the direction in which the first groove extends, and through the first aperture, the fixed terminal including a fixed contact disposed on the first terminal portion and a first protrusion disposed on the second terminal portion and protruding into the first groove, and a movable contact piece including a movable contact arranged to face the fixed contact on the fixed terminal.

2. The electromagnetic relay according to claim 1, wherein the first groove includes an opening that opens toward the upper, contact-supporting surface of the base member, and the first protrusion is configured to be inserted into the first groove via the opening.

3. The electromagnetic relay according to claim 2, wherein the first groove includes a disposition portion in which the first protrusion is disposed; an opening-side portion disposed closer to the opening than the disposition portion, a width of the opening-side portion being larger than a width of the disposition portion; and a connection portion having a width that decreases from the opening-side portion toward the disposition portion.

4. The electromagnetic relay according to claim 1, wherein the fixed terminal is further bent to define a third terminal portion extending from a second end of the first terminal portion that is opposite to the first end of the first terminal portion, the third terminal portion extending parallel to the second terminal portion.

5. The electromagnetic relay according to claim 4, wherein the base includes a second aperture disposed near the lower portion of the support member;

the support member further includes a second lateral side surface having a second groove that extends from near the upper, contact-supporting surface of the support member toward the second aperture; and the third terminal portion includes a second protrusion and extends along the second lateral side surface of the support member, in the same direction as the direction as which the second groove extends, and through the second aperture, with the second protrusion protruding into the second groove.

6. The electromagnetic relay according to claim 1, further comprising a magnet portion configured to generate a magnetic field, wherein the movable contact piece is configured to move in a first direction including a contact direction in which the movable contact approaches the fixed contact and a separation direction in which the movable contact separates from the fixed contact, and the magnetic field is generated in a second direction orthogonal to the first direction so as to extend an arc generated between the fixed contact and the movable contact upon separation of the movable contact from the fixed contact.

* * * * *